United States Patent [19]

Trame

[11] 4,220,948

[45] Sep. 2, 1980

[54] NON-ELECTRONIC CHARACTER DISPLAY

[75] Inventor: Charles E. Trame, Mequon, Wis.

[73] Assignee: Everbrite Electric Signs, Inc., South Milwaukee, Wis.

[21] Appl. No.: 950,920

[22] Filed: Oct. 12, 1978

[51] Int. Cl.[2] ..... G08B 5/02

[52] U.S. Cl. ..... 340/378.2; 340/764

[58] Field of Search ..... 340/764, 378.2; 40/491; 116/324

[56] References Cited

U.S. PATENT DOCUMENTS

| | | | |
|---|---|---|---|
| 1,577,609 | 3/1926 | Chubb | 340/764 UX |
| 2,426,079 | 8/1947 | Bliss | 340/764 UX |
| 3,402,694 | 9/1968 | Christman | 116/324 |
| 3,485,204 | 12/1969 | Christman | 116/324 |

*Primary Examiner*—Harold I. Pitts

*Attorney, Agent, or Firm*—Ralph G. Hohenfeldt

[57] ABSTRACT

A sign board comprises an opaque front plate interfacing with a translucent or reflective back plate. Slots in the front plate define the segments of 7-segment characters. Shutters are slideable within the interface to selectively open and close slots for defining individual characters. Means are provided for retaining the shutters in open and closed positions.

13 Claims, 11 Drawing Figures

Fig. 5
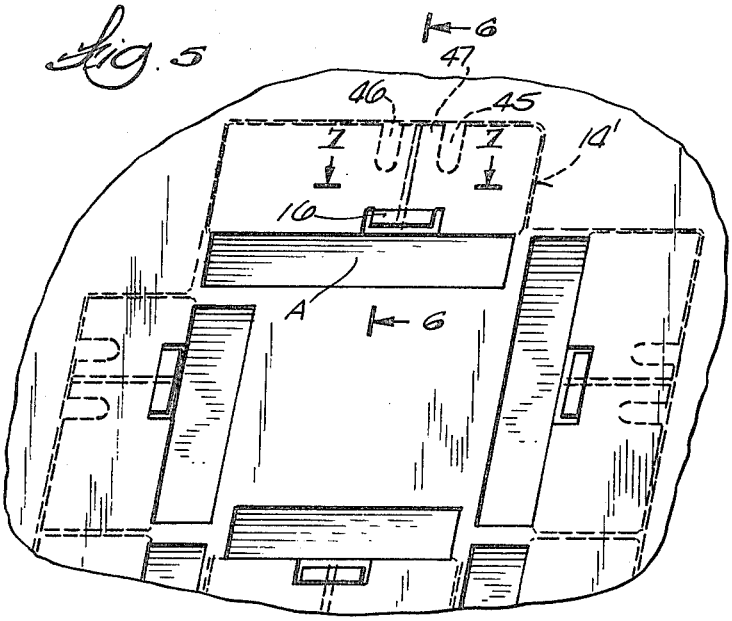
Fig. 6
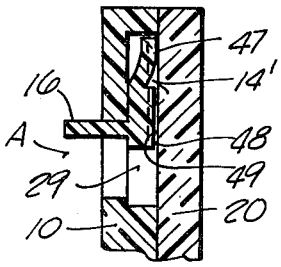
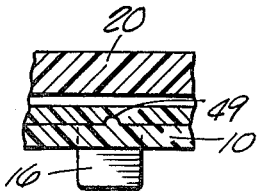
Fig. 7
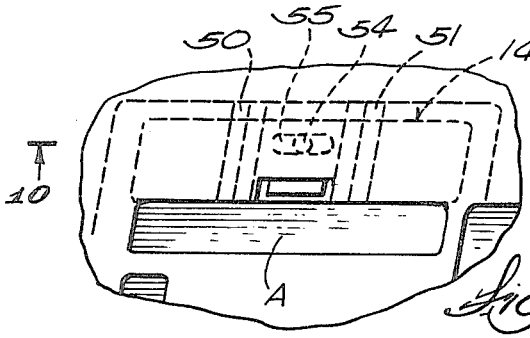
Fig. 9
Fig. 8
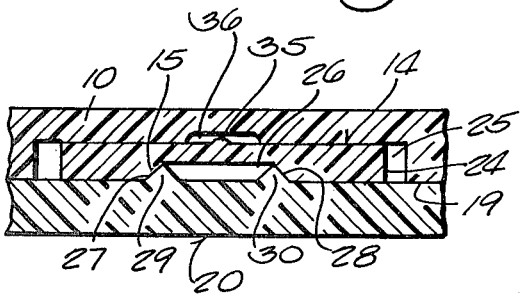
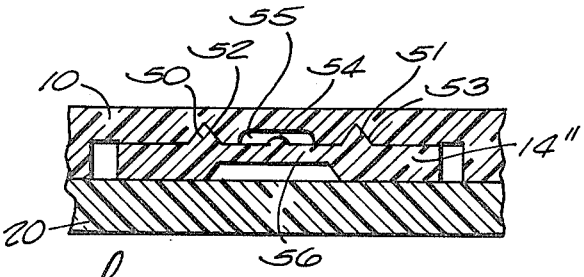
Fig. 10
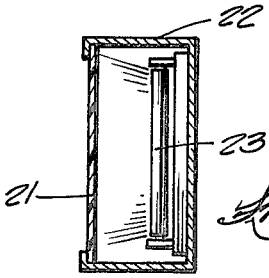
Fig. 11

NON-ELECTRONIC CHARACTER DISPLAY

This invention relates to character displays for changeable signs and, in particular, to signs in which the segments comprising a number or other character are defined by openings in an opaque plate and there are shutters for selectively closing some segments so those which remain open will define the desired character.

The new character forming means has application in signs such as are used in restaurants and stores to display sales prices of items or services or it may be used as a scoreboard to give but a few examples of its use.

Signs which use shutters to close elongated openings for the purpose of defining a letter or numeral are known as evidenced by U.S. Pat. No. 2,426,079, dated Aug. 19, 1947. This patent illustrates a sign comprised of a plate in which each character is outlined by seven slots or segment openings which can be closed selectively with shutters to define any numeral from 0 to 9. The shutters are driven by relays so that numerals may be formed from a remote position. Since the shutters must be shifted from behind the front plate, this type of sign lacks the capability of allowing its numerals to be formed or altered from the front. Electromechanical signs of this type are also expensive to build and maintain.

U.S. Pat. No. 1,577,609, dated Mar. 23, 1926, also shows a changeable sign wherein shutters are rotated to selectively close openings for the purpose of defining the outlines of numerals or other designs. This particular construction is costly to manufacture and does not create numerals which have sufficient clarity and definition to be used in a price display board or a scoreboard which might have to be viewed from a substantial distance.

SUMMARY OF THE INVENTION

Objects of the present invention are to provide a sign which can be readily mass produced at comparatively low cost, which is simple in construction and, hence, essentially maintanence-free, which has numerals that are sharply defined and, hence, legible from a substantial distance in view of their size, which has stable numerals regardless of the position in which it is oriented, and which is adapted for modular construction so that a sign of any size may be easily fabricated.

In accordance with the invention, each of the sign panels or modules comprises interfacing front and back plates. The numerals are defined in the front plate by seven segments or openings arranged to form the outline and the middle or cross segment of a numeral. A sliding shutter is interposed between the interfacing plates adjacent each of the segment openings. Each shutter has a tab extending through the opening to enable it to be grasped and slid to open or close the openings selectively for defining numerals. The shutters run on tracks or runners which keep them in alignment and easily movable without jamming or binding. Each shutter has detent means for securing it in its full open or closed position. The sign is made in a manner that permits the numerals to be illuminated from the rear, or, alternatively, from the front in which case the numerals are illuminated with ambient light.

In one version, viewing a sign from the front is enhanced as a result of fluorescent dye or pigment being used in the back plate.

How the foregoing objects and other more specific objects and features of the invention are achieved, will be evident in the ensuing more detailed description of a preferred embodiment of the new sign which will now be set forth in reference to the drawings.

DESCRIPTION OF THE DRAWINGS

FIG. 5 is an alternative 7-segment character construction;

FIG. 6 is a partial section taken on the line 6—6 in FIG. 5;

FIG. 7 is a partial section taken on the line 7—7 in FIG. 5;

FIG. 8 is a section through one type of shutter taken on the line 8—8 in FIG. 3;

FIG. 9 is a fragmentary view of an alternative type of shutter;

FIG. 10 is a section of a shutter taken on the line 10—10 in FIG. 9; and FIG. 11 is a schematic cross sectional view of a sign assembly in which the new sign panel can be used.

DESCRIPTION OF A PREFERRED EMBODIMENT

Figure 1:
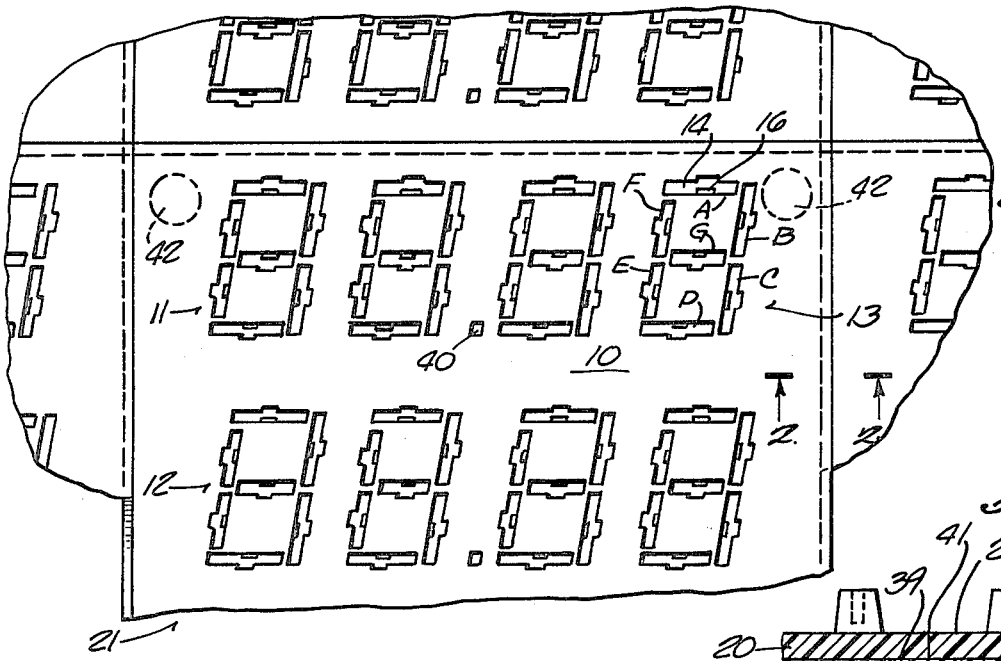
FIG. 1 is a front view of the sign showing two rows of numeral characters in one panel or module and partial characters in adjacent modules.

In FIG. 1, each of the modules or sign panels comprises a front plate 10 which is planar and preferably opaque. In this embodiment, front plate 10 is made of a material that does not absorb moisture, such as metal or plastic, but elastic is preferred since it enables forming the part easily by molding which is one of the advantages of the new sign construction.

Front plate 10 in FIG. 1 exhibits two rows of numerals 11 and 12 that are defined by elongated slots or openings, which in one of the numerals marked 13 are identified by the letters A–G in accordance with conventional practice for giving the positional identification of 7-segment characters. Adjacent each of the elongated openings A–G and the backside of the front plate 10 is a slideable shutter. The cross sectional configuration of a shutter is visible in FIG. 4 where it is generally designated by the reference numeral 14 and is seen to comprise a bar-like base portion 15 and an upstanding tab 16 which enables the shutter to be grasped and slid for being advanced to close or retracted to open a segment opening in front plate 10 such as the one marked A in FIG. 4. Other segment openings such as those marked G and D in FIG. 4 also shutters marked 17 and 18. All shutters are constructed similarly in any particular embodiment of the sign. Shutters 14 and 18 are in open position and shutter 17 is closed in FIG. 4. Thus, front plate 10 constitutes a mask having segment openings behind which the various shutters are movable. To form a character such as the numeral 3, segment openings A, B, C, D and G would be open and openings F and E would be closed by their associated shutters.

Figure 4:
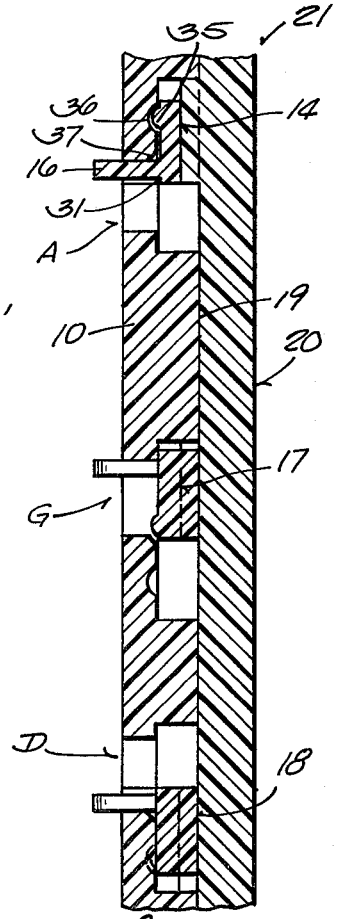
FIG. 4 is a partial section taken on the irregular line 4—4 in FIG. 3.

FIG. 4 also illustrates how the rear surface 19 of opaque front plate 10 interfaces with the front surface of a back plate 20 which is preferably made of molded plastic and, in accordance with the invention, may be clear and transparent, opalescent or, in certain versions, may have fluorescent dye distributed in it. The panel or module comprised of a front plate 10 and a back plate 20 is generally designated by the reference numeral 21 in FIG. 4.

In FIG. 11, the panel 21 is shown mounted in the front of a box 22 in which there is a light source symbolized by the fluorescent tube 23. A light source is used in most models of the sign because it results in the character segments which are open being brightly illuminated and visible from the front of the sign in an otherwise dark room. Other versions of the sign have no back lighting but use ambient or other front lighting to make the segments which are not covered by shutters visible. Reflectivity off of the front surface of back plate 20 may be relied upon exclusively for making the segment openings adequately bright and legible but, as suggested above, brightness can be enhanced by using a back plate 20 which fluoresces when exposed to light.

A typical manually operable shutter 14 will now be considered in detail. As can be seen in FIG. 8 the shutter has a bar-like base portion 15 which appears in section in this figure. Each shutter runs in an elongated recess 25 which is formed in the back surface of front plate 10. Note that the length of the recess is greater than the length of the shutter so that the shutter can slide without its edges 24 binding as might occur if the shutter and its recess fit too tightly and were slightly misaligned. The opaque front plate or mask 10, of course, prevents unwanted light from passing through the gap between the edge of a shutter and its recess 25.

In FIG. 8, the bottom surface of shutter base portion 15 has a channel or groove means having a flat top 26 and having sides 27 and 28 which diverge toward back plate 20. A pair of short runners 29 and 30, having substantially triangular cross section, are molded integrally with the front surface of back plate 20. The upwardly converging outsides of the respective triangular runners 29 and 30 constitute surfaces on which the diverging sides 27 and 28 of the shutter channel run. Thus, the shutters are compelled to move in a straight line without chattering when they are caused to move by applying a force to upstanding manually engageable tab 16 which is an integral part of the shutter and which does not appear in the FIG. 8 section but is visible in FIG. 1. The length of runners 29 and 30 is evident from inspection of FIGS. 3 or 4. The runners do not extend across openings A–G.

The shutters such as 14 are also provided with detent means for maintaining them in retracted or open and advanced or closed position. As can be seen in FIGS. 4 and 8, for this purpose the top of the shutter base portion 15 is provided with a centrally located projection 35 or dimple which has a hemispherical contour. The rear surface of front plate has a short transverse groove 36 which has a cross section that is complementary to the shape of detent projection 35 on the shutter. The shutter 14 is made of plastic and has thin enough cross section in its mid-section to allow it to bend slightly and enable projection 35 to move crosswise of and out of groove 36 when the shutter 14 is slid and advanced downwardly, as it appears in FIG. 4 to close segment opening A. The edge of opening A is beveled or chamfered as at 37. All segment openings B–G are similarly chamfered at this location. When the shutter is moved sufficiently for it to fully close opening A, detent projection 35, being biased by the elasticity of base portion 15, springs up against chamfer 37 and holds the shutter in closed position over segment opening A. The shutters for the other segments B–G have similar detent means and operate in the same way.

Note in FIG. 1 that the front masking plate 10 has a square opening 40 which is illuminated through the back plate 20, or from the front in some versions of the sign, and serves as a decimal point. Note, that with the segment openings and the shutter bars being rectangular in this design, as opposed to having their corners cut at a bias as in some character designs, the shutters can be moved without occluding the decimal point and the decimal point can be placed centrally between adjacent digits.

Figure 3:
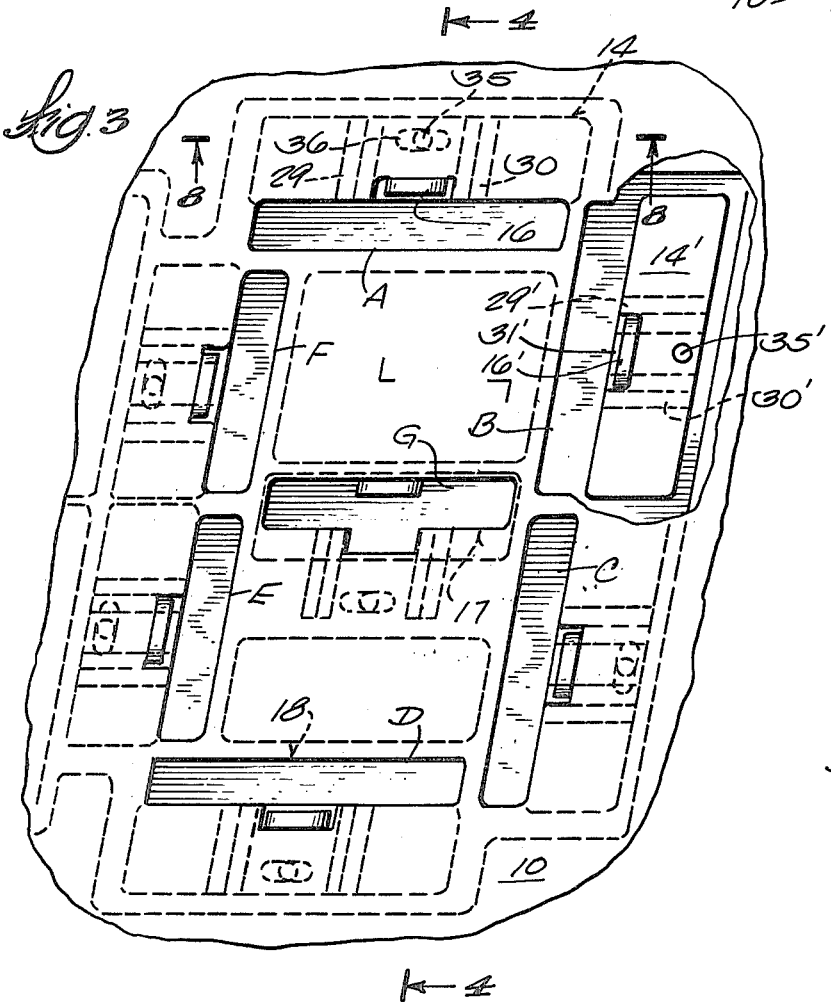
FIG. 3 is a plan view of one of the 7-segment numerals depicted in a module in FIG. 1.

In the upper right portion of FIG. 3 the opaque front plate or mask 10 is partially broken away to show a plan view of a shutter 14', its detent 35' and its operating tab 16'. This shutter is cooperating with segment opening B. The runners or tracks 29' and 30' which are molded on back plate 20 are also visible. Note in FIG. 4 that the leading edge 31 of shutter 14 extends slightly beyond tab 16 so this edge can slide under the part of front plate 10 that overhangs shutter recess 35 to thereby assure that no light will leak along the leading edge of the shutter when it is in closed position. All of the shutters are made the same way, that is, with the tab 16 set back so as to provide an unobstructed leading edge 31.

The shutters 14 are opaque and may be made of the same material as front plate 10. As suggested earlier, the opaque front plate 10 can be made of metal or of plastic which does not absorb moisture such as acrylic, polycarbonate, and polystyrene with an opacifying filler. The shutters may be made of similar material. The back plate may be made of one of these or other transparent or translucent plastics without an opacifying filler.

Figure 2:
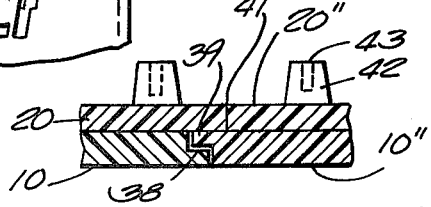
FIG. 2 is a fragmentary section taken on the line 2—2 in FIG. 1.

The panels 21, which usually have several rows of segmented characters are made, in this embodiment, as modules that can be assembled with other similar modules to make a large area sign or price board. As can be seen in FIG. 2, adjacent modules may be interlocked with a tongue and groove arrangement. For this purpose, the left edge of one front plate 10 is notched out at 38 to complement a corresponding tongue 39 on the right edge of the next adjacent front panel 10 which is marked 10'' in this view. The back plates 20 and 22' form an abutting joint 41 when the panels are arranged in modular fashion. These joints are not visible because of the opacity of the front panel. The back plates 20 are also provided with bosses 42 as can be seen in FIG. 2. These bosses are for mounting the panels as required. They are provided with a hole 43 for receiving a mounting screw.

It should be understood that back plates 20 are preferably molded in one piece with the shutter runners 29 and 30 extending upwardly from and properly arranged on the surface of the back plate. In final assembly, that is, after the shutters have been inserted in recesses 25 of the front plate 10, adhesive is applied at the interface 19, as in FIG. 4, of the front and back plates 10 and 20 so that the modules will not disassemble inadvertently. Any adhesive which is compatible with the chosen front and rear plate materials may be used. Of course, at greater expense and inconvenience, the front and back plates may be held together in interfacing relationship by screws or bolts or sonic welding or other clamping means, not shown.

Generally, the color of the opaque shutters should match the color of the opaque front plate or mask since this makes the shutters substantially visually imperceptible when an observer is at a relatively short distance from the sign which is desirable.

It would be possible to have the recesses in which the shutters slide formed in the back plate 20 instead of the front plate 10 as illustrated herein and the runners for the shutters could be on the front plate but this arrangement is not preferred.

An alternative form of shutter, generally designated by the reference numeral 14, is depicted in the FIG. 5, 6 and 7 embodiment. As can be seen in FIG. 5, the detent effect is obtained with these shutters by providing them with a pair of spaced-apart slots or notches 45 and 46 which create a springy tongue 47 between them. As can be seen in FIG. 6, tongue 47 is formed with a bend or offset which causes it to drag on a surface 48 of back plate 20. The front plate 10 has a recess 29 in which shutter 14' can slide. The bent out more deflected tongue 47 of the shutter serves as a detent by reason of its frictional engagement with back plate front surface 48. This substitute for a detent aids in securing the shutter in either its opened or closed position. As can be seen in FIGS. 5 and 7, this embodiment of the shutter desirably has a runner 49 formed on it for engaging in a complementarily-shaped groove in the back plate 20. Runner 49, like the others 29 and 30, keeps the shutter on a straight line when it is being moved and the deflected portion provides the frictional drag.

FIGS. 9 and 10 show an alternative form of shutter 14''. This shutter has a pair of runners 50 and 51 molded integrally with it. The runners 50 and 51 are triangular in cross section as are the runners 29 and 30 for the shutters in the FIG. 1–4 embodiment where the runners are molded onto the back plate 20 instead of on shutter 14'' as in the FIG. 10 embodiment. In this embodiment, the runners 50 and 51 slide in complementarily v-shaped grooves 52 and 53, respectively, which are formed when front plate 10 is molded. Grooves 52 and 53 do not extend into and do not appear in the segment openings when the shutter is parked or retracted so that the opening is passing light. In this embodiment, the back plate can be a single flat plate without recesses or runners for the shutters. As in some of the other embodiments, the shutter 14'' in FIG. 10 has a projection 54 extending from its upper surface for serving as a detent in cooperation with an elongated shallow transverse groove 55 which is formed during the process of molding front plate 10. Note also that the shutter 14'' in FIG. 10 has a thin central section 56 which imparts some flexibility to the shutter and allows the detent projection 54 to yield elastically as it is disengaged from groove 55 and moved to its shutter closing position where it is reengaged with a chamfered edge of the segment opening as was explained in connection with FIG. 4 where the chamfered edge is marked 37.

In summary, the shutters associated with the respective character defining segment openings A–G which comprise each numeral may be slid selectively from segment closed position to open position to define the outline of any 7-segment numeral between 0 and 9 in this example. The shutters are locked in opened or closed position by detents or frictional means. The sign may be backlighted, in which case the backing plate must be light transmissive, or it can be front lighted in which case the backing plate could be opaque or reflective or impregnated with fluorescent material to make the exposed or opened segments more visible. All of the parts may be molded from plastic. Assembly is a simple repetitive process involving setting the shutters for each numeral in their recesses in the front plate or mask and then bonding or otherwise fastening the back plate to this subassembly. The sign is essentially maintenance-free. The shutters are the only moving parts but they are not driven electrically nor with a mechanism that would require maintanence. Signs of various character sizes can be designed by simply making dimensional changes which are proportional to the dimensions of a basic model. The signs can be used indoors or outdoors provided they are covered in the latter case to preclude icing or other surface contamination. The new character generator means is ideal for use in a price board or a score board or any other alphanumeric display. An important feature of the invention is that there are few parts and all of them, including the front plate, rear plate and shutters are molded so the sign lends itself to economical mass production. Its modular qualities allow signs of any desired practical size to be assembled.

Although embodiments of the new sign have been described in considerable detail, such description is intended to be illustrative rather than limiting, for the invention may be variously embodied and is to be limited only by interpretation of the claims which follow.

I claim:

1. A character display device comprising:

an opaque front plate member having front and rear faces and having groups of elongated openings arranged as segments for being selectively opened and closed to delineate a character, a back plate member having front and rear faces and having its front face in interfacing spaced relationship with the rear face of said front plate, a shutter member disposed in the space adjacent the respective openings for being moved manually between a retracted position in which it opens said opening and an advanced position in which it closes said opening, each shutter member having its length dimension extending correspondingly with the length of said elongated openings and having a width dimension less than its length, said member being movable in the direction of its width dimension, one of a selected one of said plate members and a shutter member having groove means in it directed transversely to the length of the shutter member and the other of said selected plate member and shutter member having runner means on it for projecting into said groove means to effect sliding engagement between said runner means and groove means and to provide the only required guidance for movement of said member between advanced and retracted positions, said runner and groove means being located intermediately of the ends of said shutter length dimension.

2. The device as in claim 1 wherein said shutter member is a bar-like element having a thin section intermediate of its ends for enabling it to flex, and holding means for holding said shutter means in the position to which it is moved comprising a projection located on said thin section, said recess having a groove into which said projection projects for holding said shutter in retracted position and from which said projection can withdraw because of said flexing of said section in response to movement of said shutter toward advanced position.

3. A character display device comprising:

an opaque front plate member having front and rear faces and having groups of elongated openings arranged as segments which delineate a character, a back plate member having front and rear faces and having its front face interfaced with the rear face of said front plate, said front and rear plate members cooperating to define recesses at their interface adjacent said elongated openings, respectively, a shutter member disposed in the recesses, respectively, for being moved between a retracted position in which it opens said openings and an advanced position in which it closes said opening, one of said shutter member and said front plate having runner means projecting from it and extending in the line of movement of said shutter member, and the other of said shutter member and said front plate having groove means into which said runner means project, said runner means and said groove means cooperating to guide said shutter means during movement.

4. A character display device comprising:

an opaque front plate member having front and rear faces and having groups of elongated openings arranged as segments which delineate a character, a back plate member having front and rear faces and having its front face interfaced with the rear face of said front plate, said front and rear plate members cooperating to define at their interface adjacent said elongated openings, respectively, a shutter member disposed in the recesses, respectively, for being moved between a retracted position in which it opens said opening and an advanced position in which it closes said opening, one of said shutter member and said back plate having runner means projecting from it and extending in the line of shutter member movement, and the other of said shutter member and said back plate having groove means into which said runner means project, said runner means and said groove means cooperating to guide said shutter means during movement.

5. The device as in claim 1 wherein said shutter member is a planar bar-like element of plastic material having notches in its edge to define a tongue between them, said tongue being flexible and deflected outwardly from the plane of said element for producing frictional force in said recess to thereby act as said shutter holding means.

6. The device as in claim 1 wherein said front and rear plate members are held together in interfacing relationship by adhesion of one plate member to the other.

7. The device as in claim 1 wherein said front plate and back plate are fastened to each other as a modular panel and are shaped at their edges to define a tongue on one edge and a groove at the opposite edge to enable said modular panels to be interlocked with other similar modular panels.

8. The device as in any of claims 1, 2, 3, 4, 5, 6 or 7 wherein said back plate is composed of light-transmissive material.

9. The sign as in any of claims 1, 2, 3, 4, 5, 6 or 7 wherein said back plate is composed of plastic material which includes fluorescent material.

10. A panel for selectively displaying numerals comprising:

a generally planar opaque front plate member molded from plastic material and having groups of elongated openings arranged as segments which delineate numerals, a generally planar back plate member molded from plastic material and interfaced with said front plate member, said front and rear plate members cooperating to define recesses between their interfaces in the vicinity of said elongated openings, respectively, a bar-like shutter member disposed for sliding in each of said recesses between a retracted position, at which time said opening is open, and an advanced position at which time said opening is covered by said shutter member, said shutter including a portion having a thin section for enabling it to flex and detent means projecting from said thin section, one of said front plate or said rear plate having a recess into which said detent means projects for holding said shutter member in retacted position, said thin section flexing to allow said detent means to withdraw from said recess when said shutter member is slid, one of said shutter member and a selected one of said back plate or front plate having runner means molded thereon and extending in the line of movement of said shutter member and, the other of said shutter member and said selected plate having groove means into which said runner means projects, said groove and runner means each having sufficiently great lengths to constrain said shutter member to move in a straight line.

11. The panel as in claim 10 wherein said elongated openings are chamfered at one of their edges for enabling said detent projection to be biased against said one edge under the influence of force resulting from said flexing to thereby hold said shutter member in advanced position.

12. The panel as in any of claims 10 or 11 wherein said back plate is adhered to said front plate.

13. The panel as in any of claims 10, 11 or 12 wherein said back plate is composed of one of transparent plastic material and plastic material including fluorescent material.

* * * * *

UNITED STATES PATENT AND TRADEMARK OFFICE

CERTIFICATE OF CORRECTION

PATENT NO. : 4,220,948

DATED : September 2, 1980

INVENTOR(S) : Charles E. Trame

It is certified that error appears in the above-identified patent and that said Letters Patent are hereby corrected as shown below:

Claim 4, Column 7, Line 25, after "define" insert --recesses--

Claim 10, Column 8, Line 25, after "shutter", second occurrence, insert --member--

Claim 10, Column 8, Line 30, "retacted" should read --retracted--

Signed and Sealed this

*Twenty-fifth* Day of *November 1980*

[SEAL]

*Attest:*

SIDNEY A. DIAMOND

*Attesting Officer*

*Commissioner of Patents and Trademarks*